US011618932B2

(12) United States Patent
Saito et al.

(10) Patent No.: US 11,618,932 B2
(45) Date of Patent: Apr. 4, 2023

(54) STEEL SHEET FOR TWO-PIECE CAN AND MANUFACTURING METHOD THEREFOR

(71) Applicant: JFE Steel Corporation, Tokyo (JP)

(72) Inventors: Hayato Saito, Tokyo (JP); Nobusuke Kariya, Tokyo (JP); Katsumi Kojima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 593 days.

(21) Appl. No.: 16/496,048

(22) PCT Filed: Mar. 12, 2018

(86) PCT No.: PCT/JP2018/009399
§ 371 (c)(1),
(2) Date: Sep. 20, 2019

(87) PCT Pub. No.: WO2018/180404
PCT Pub. Date: Oct. 4, 2018

(65) Prior Publication Data

US 2020/0024681 A1 Jan. 23, 2020

(30) Foreign Application Priority Data

Mar. 27, 2017 (JP) ..... JP2017-060545

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/46* (2013.01); *C21D 6/005* (2013.01); *C21D 6/008* (2013.01); *C21D 8/0205* (2013.01); *C22C 38/001* (2013.01); *C22C 38/002* (2013.01); *C22C 38/02* (2013.01); *C22C 38/04* (2013.01); *C22C 38/06* (2013.01)

(58) Field of Classification Search
CPC ..... B32B 15/09; B32B 15/18; Y10T 428/31678; C21D 6/005; C21D 6/008; C21D 8/0205; C21D 8/0226; C21D 8/0247; C21D 9/46; C22C 38/001; C22C 38/002; C22C 38/02; C22C 38/04; C22C 38/06
USPC ..... 428/457
See application file for complete search history.

(56) References Cited

U.S. PATENT DOCUMENTS

| | | | | |
|---|---|---|---|---|
| 6,334,910 | B1 | 1/2002 | Sato et al. | |
| 2017/0306436 | A1 * | 10/2017 | Saito et al. | C21D 9/46 |

FOREIGN PATENT DOCUMENTS

| | | | | | |
|---|---|---|---|---|---|
| CN | 1429924 | A | | 7/2003 | |
| JP | 02141535 | A | * | 5/1990 | C21D 8/04 |
| JP | 08192202 | A | | 7/1996 | |
| JP | 10280095 | A | | 10/1998 | |
| JP | 11124654 | A | * | 5/1999 | C21D 9/46 |
| JP | 11189841 | A | | 7/1999 | |
| JP | 2000087145 | A | | 3/2000 | |
| JP | 2001335888 | A | | 12/2001 | |
| JP | 2002060900 | A | | 2/2002 | |
| JP | 2003013146 | A | * | 1/2003 | B21B 1/22 |
| WO | 9963124 | A1 | | 12/1999 | |
| WO | 2016067514 | A1 | | 5/2016 | |
| WO | WO-2016067514 | A1 | * | 5/2016 | C21D 9/46 |

OTHER PUBLICATIONS

Korean Office Action for Korean Application No. 10-2019-7027775, dated Dec. 1, 2020 with Concise Statement of Relevance of Office Action, 7 pages.
Chinese Office Action for Chinese Application No. 201880020785.5, dated Nov. 16, 2020 with Concise Statement of Relevance of Office Action, 9 pages.
International Search Report and Written Opinion for International Application No. PCT/JP2018/009399, dated May 15, 2018—5 pages.
Non Final Office Action for U.S. Appl. No. 16/495,991, dated Apr. 27, 2022, 24 pages.
Restriction Requirement for U.S. Appl. No. 16/495,991, dated Feb. 14, 2022, 9 pages.

* cited by examiner

*Primary Examiner* — Daniel J. Schleis
(74) *Attorney, Agent, or Firm* — RatnerPrestia

(57) ABSTRACT

A steel sheet for a two-piece can, the steel sheet includes: by mass %, C: 0.010% or more and less than 0.050%; Si: 0.04% or less; Mn: 0.10% or more and less than 0.40%; P: 0.02% or less; S:0.020% or less; Al: more than 0.030% and 0.100% or less; N: 0.0005% or more and less than 0.0030%; B: 0.0005% to 0.0030%; and balance Fe and inevitable impurities, wherein an amount of N that is present as BN and a whole amount of N satisfy the following expression (1):

$$[N \text{ as } BN]/[N]>0.5 \quad (1),$$

where N as BN represents the amount of N that is present as BN, and N represents the whole amount of N, tensile strength is 420 MPa to 540 MPa, elongation is 5% or more, yield elongation is 3% or less, and $\Delta r$ is −0.50 to 0.10.

7 Claims, No Drawings

STEEL SHEET FOR TWO-PIECE CAN AND MANUFACTURING METHOD THEREFOR

CROSS REFERENCE TO RELATED APPLICATIONS

This is the U.S. National Phase application of PCT/JP2018/009399, filed Mar. 12, 2018, which claims priority to Japanese Patent Application No. 2017-060545, filed Mar. 27, 2017, the disclosures of each of these applications being incorporated herein by reference in their entireties for all purposes.

FIELD OF THE INVENTION

The present invention relates to a steel sheet for a can that is suitable for application to a material for a can container used for food cans, beverage cans, aerosol cans, and the like, and a manufacturing method therefor, particularly to a steel sheet for a two-piece can having high strength and excellent processability, and a manufacturing method therefor.

BACKGROUND OF THE INVENTION

From the standpoint of reduction in recent environmental load and cost reduction, reducing the amount of steel sheets used for food cans, beverage cans, aerosol cans, and the like is required. For this reason, irrespective of a two-piece can or a three-piece can, the thickness of steel sheets serving as a material is being reduced. By contrast, if the thickness of steel sheets is reduced, pressure-resistance strength of a can body is reduced. In order to compensate for reduction in pressure-resistance strength of a can body, highly strengthening steel sheets are required. However, if steel sheets are highly strengthened, processability is reduced. Thus, in neck flange processing and can body part processing such as bead and emboss, forming defect such as cracks is likely to occur. In addition, the processing into a two-piece can requires making an ear (earing) small enough in drawing processing and not generating stretcher strains. In order to ensure corrosion resistance, a request for omitting steps such as drying and baking necessary for a coating step and reducing energy costs by using laminated steel sheets instead of coating tin steel sheets and TFS steel sheets becomes strong.

For example, as a steel sheet for a two-piece can, Patent Literature 1 discloses a steel sheet for a drawn can having extremely excellent earing characteristics. The steel sheet for a drawn can has the composition consisting of, by weight %, C: 0.010-0.100%, Si: ≤0.35%, Mn: ≤1.0%, P: ≤0.070%, S: ≤0.025%, sol. Al: 0.005-0.100%, N: ≤0.0060%, B: B/N=0.5-2.5, and the balance Fe and inevitable impurities, and randomizes a crystal orientation of the steel sheet by defining a heating speed upon recrystallization annealing as 5° C./s or higher in a range where a sheet thickness t is 0.15-0.60 mm and a Δr value is +0.15--0.08.

Patent Literature 2 discloses a steel sheet for a two-piece container having excellent neck wrinkle resistance. The steel sheet for a two-piece container includes, by weight %, C: 0.01-0.05% and N: 0.004% or less, and satisfies (N existing as Aln)/(contained N)≥0.5.

As a laminated steel sheet for a two-piece can, Patent Literature 3 discloses a steel sheet for a resin coated steel sheet that is an original sheet used for a resin coated steel sheet suitable for use of a thinned deep drawn and ironed can. The components of the original sheet consist of C: 0.008-0.08%, Si≤0.05%, Mn≤0.9%, P≤0.04%, S≤0.04%, Al≤0.03%, N≤0.0035%, the balance Fe and inevitable impurities, and an average crystal grain size of the original sheet before coating a resin is 8 μm or less and the maximum surface roughness (Rmax) is 5 μm or less.

Patent Literature 4 discloses manufacture of a steel sheet for a two-piece can excellent in uniformity of in-plane anisotropy in a coil. In the manufacture of a steel sheet for a two-piece can, when a continuously cast thin slab that has chemical component composition containing C: 0.01 to 0.10 wt. % or a rough bar obtained by rough-rolling a continuously cast thin slab is hot-finish-rolled into a steel strip, the continuously cast thin slab or the rough bar over the entire width direction is heated by an induction heating device arranged on an entry side of a hot-finish-rolling mill so as to adjust a finish-rolling entry side temperature thereof, the continuously cast thin slab or the rough bar is hot-finish-rolled so as to fabricate a hot-rolled steel strip so that a finish-rolling exit side temperature is Ar3 transformation point or higher and Ar3 transformation point+40° C. or lower over the whole length from the tip end to the tail end of the steel strip and a finish sheet thickness is 2.3 mm or less, and the obtained hot-rolled steel strip is wound in a coil shape and pickled. After that, the hot-rolled steel strip is cool-rolled, the obtained cool-rolled steel strip is annealed, is skin-pass-rolled or secondary-rolled so as to make the steel strip having a sheet thickness of 0.25 mm or less, and surface processing is applied to the steel strip.

As a steel sheet for a battery can but use of a two-piece can, Patent Literature 5 discloses a steel sheet for a two-piece battery can having excellent tightness of a sealed-part. The steel sheet for a two-piece battery can has steel composition consisting of, by weight %, 0.01%<C<0.03%, 0.02%≤sol. Al≤0.15%, and N≤0.0035%, and is processing-hardened by secondary rolling after annealing.

PATENT LITERATURE

Patent Literature 1: Japanese Patent Application Laid-open No. 2002-60900

Patent Literature 2: Japanese Patent Application Laid-open No. 10-280095

Patent Literature 3: International Publication Pamphlet No. 99/63124

Patent Literature 4: Japanese Patent Application Laid-open No. 2000-87145

Patent Literature 5: Japanese Patent Application Laid-open No. 11-189841

SUMMARY OF THE INVENTION

However, the conventional techniques described above have the following problems.

Patent Literature 1 discloses the fact that over-aging treatment is applied to a steel sheet for a can that is soft and has excellent aging resistance as a material other than an earing after continuous annealing with a box annealing method when the steel sheet for a can is manufactured. However, in the over-aging step of box annealing, sufficient softening and aging resistance cannot always be obtained in addition to great variation in a coil. Thus, with a steel sheet disclosed in Patent Literature 1, excellent formability is unlikely to be implemented in ironing processing. In addition, additional manufacturing costs are required in box annealing.

In a steel sheet disclosed in Patent Literature 2, a coarse nitride remains and pin holes are generated because a slab heating temperature is 1,100° C. or lower. In addition, concrete expertise regarding tensile strength for improving processability and an earing is not disclosed.

In a steel sheet disclosed in Patent Literature 3, because an additive amount of Al is as low as 0.03% or less, generation of AlN is insufficient and solid solution N remains. Thus, stretcher strains cannot sufficiently be reduced. In addition, concrete expertise regarding tensile strength and control of an earing is not disclosed.

Patent Literature 4 does not disclose concrete expertise regarding tensile strength, yield elongation, and control of elongation. Thus, a steel sheet disclosed in Patent Literature 4 cannot obtain these characteristics necessary for thickness reduction.

In a steel sheet disclosed in Patent Literature 5, sufficient elongation cannot be obtained and formability becomes insufficient because over-aging treatment is not performed in an annealing step.

In view of the foregoing, an object of the present invention is to provide a steel sheet for a two-piece can having high strength and excellent formability in drawing processing and ironing processing, and a manufacturing method therefor.

Inventors of the present invention have conducted research earnestly to solve the problems described above. Specifically, the inventors of the present invention have earnestly conducted research in order to find compatibility between high strengthening of a steel sheet advantageous to an increase in pressure-resistance strength, and earing characteristics and stretcher strain characteristics necessary for drawing processing. As a result, the inventors have found that the problems described above can be solved if component composition, tensile strength, elongation, Ar, and yield elongation are adjusted in a specific range, and have completed the present invention based on this expertise.

To solve the problem and achieve the object, in a steel sheet for a two-piece can according to embodiments of the present invention, the steel sheet includes: by mass %, C: 0.010% or more and less than 0.050%; Si: ≤0.04% or less; Mn: 0.10% or more and less than 0.40%; P: 0.02% or less; S: 0.020% or less; Al: more than 0.030% and 0.100% or less; N: 0.0005% or more and less than 0.0030%; B: 0.0005% to 0.0030%; and balance Fe and inevitable impurities, wherein an amount of N that is present as BN and a whole amount of N satisfy the following expression (1):

$$[\text{N as BN}]/[\text{N}]>0.5 \quad (1),$$

where N as BN represents the amount of N that is present as BN, and N represents the whole amount of N, tensile strength is 420 MPa to 540 MPa, elongation is 5% or more, yield elongation is 3% or less, and Δr is −0.50 to 0.10.

Moreover, in the steel sheet for the two-piece can according to embodiments of the present invention, the steel sheet further includes: a film laminated layer having a thickness of 5 μm to 40 μm on both sides of the steel sheet or on a single side of the steel sheet.

Moreover, a method of manufacturing a steel sheet according to embodiments of the present invention is the method including: heating a slab at a heating temperature of 1,100° C. or higher; hot-rolling, under the condition of a hot-rolling finish temperature of 820° C. to 920° C., the slab after the heating; coiling, at a coiling temperature of 600° C. to 700° C., a hot-rolled sheet obtained by the hot-rolling; pickling the hot-rolled sheet after the coiling; cold-rolling the hot-rolled sheet under the condition of a rolling reduction ratio of 85% or more after the pickling; annealing, under the condition of an annealing temperature of 650° C. to 750° C., a cold-rolled sheet obtained by the cold-rolling; and rolling, under the condition of a rolling reduction ratio of 5% to 20%, an annealed sheet obtained by the continuous annealing.

Moreover, a method of manufacturing a steel sheet according to embodiments of the present invention is the method including: heating a slab at a heating temperature of 1,100° C. or higher; hot-rolling, under the condition of a hot-rolling finish temperature of 820° C. to 920° C., the slab after the heating step; coiling, at a coiling temperature of 600° C. to 700° C., a hot-rolled sheet obtained by the hot-rolling; a pickling the hot-rolled sheet after the coiling; cold-rolling the hot-rolled sheet under the condition of a rolling reduction ratio of 85% or more after the pickling; annealing, under the condition of an annealing temperature of 650° C. to 750° C., a cold-rolled sheet obtained by the cold-rolling and performing an over-aging treatment where a retention time in a temperature range of 380° C. to 500° C. is 30 s or more; and rolling, under the condition of a rolling reduction ratio of 5% to 20%, an annealed sheet obtained by the continuous annealing.

The present invention can provide a steel sheet for a two-piece can having high strength and excellent formability in drawing processing and ironing processing and a manufacturing method therefor.

DESCRIPTION OF EMBODIMENTS

The following describes a steel sheet for a two-piece can and a manufacturing method therefor according to embodiments of the present invention.

<Steel Sheet for a Two-Piece Can>

A steel sheet for a two-piece can according to embodiments of the present invention includes, by mass %, C: 0.010% or more and less than 0.050%, Si: ≤0.04% or less, Mn: 0.10% or more and less than 0.40%, P: 0.02% or less, S: 0.020% or less, Al: more than 0.030% and 0.100% or less, N: 0.0005% or more and less than 0.0030%, B: 0.0005% to 0.0030%, and the balance Fe and inevitable impurities. The amount of N that is present as boron nitride (BN) ([N as BN]) and the whole amount of N ([N]) satisfy the following expression (1).

$$[\text{N as BN}]/[\text{N}]>0.5 \quad (1),$$

Tensile strength of the steel sheet for a two-piece can according to embodiments of the present invention is 420 MPa to 540 MPa, elongation thereof is 5% or more, yield elongation thereof is 3% or less, and Δr is −0.50 to 0.10. Δr is an index for evaluating anisotropy of the material. Generally, the larger an absolute value of Δr is, the larger anisotropy of the material is. A Δr value can be measured by a natural frequency method disclosed in American Society for Testing and Materials (ASTM) A623M.

The following describes the steel sheet for a two-piece can according to embodiments of the present invention in order of component composition and physical properties. In the following description, "%" representing the content of each component indicates "mass %".

[C: 0.010% or More and Less than 0.050%]

C is an important element for obtaining desirable tensile strength, yield elongation, and Δr at the same time. When the content of C is 0.050% or more, carbide is excessively generated so as to reduce elongation and reduce formability. In addition, solid solution C is likely to remain and yield elongation is larger than 3%, thereby causing stretcher strains. Furthermore, Δr decreases (increases in the minus side), and a big earing is generated. Thus, an upper limit for the content of C is less than 0.050%. When Δr is nearly zero and anisotropy is made to be extremely small, an upper limit for the content of C is preferably less than 0.020%. By contrast, when the content of C is less than 0.010%, tensile strength is 420 MPa or less, thereby making it difficult to ensure pressure-resistance strength of a can body. Because a ferrite grain size is excessively coarse at the time of annealing, and surface roughening occurs at the time of can manufacturing, when a steel sheet is made into a laminated steel sheet, adhesion between a film laminated layer and the steel sheet is reduced so as to reduce corrosion resistance. Thus, a lower limit for the content of C is 0.010% or more.

[Si: ≤0.04% or Less]

If a large amount of Si is included, surface concentration causes surface processing properties to be deteriorated, and corrosion resistance is reduced. In addition, solid solution strengthening causes a yield point to increase. Thus, an upper limit for the content of Si is 0.04% or less, preferably 0.03% or less.

[Mn: 0.10% or More and Less than 0.40%]

Mn has an effect of improving tensile strength of a steel sheet by solid solution strengthening, and is likely to ensure tensile strength of 420 MPa or more. Mn forms manganese sulfide (MnS) so as to prevent hot ductility caused by S included in steel from being reduced. Furthermore, stabilizing cementite contributes to decrease in amount of solid solution C and enables yield elongation to be stably reduced. In order to obtain these effects, a lower limit for the content of Mn needs to be 0.10% or more. By contrast, when the content of Mn is 0.40% or more, anisotropy of the material is larger and an absolute value of Δr is larger. Thus, an upper limit for the amount of Mn is less than 0.40%, preferably 0.30% or less.

[P: 0.02% or Less]

If a large amount of P is included, excessive hardening and central segregation causes formability to be reduced. In addition, if a large amount of P is included, corrosion resistance is reduced. Thus, an upper limit for the content of P is 0.02% or less.

[S: 0.020% or Less]

S forms sulfide in a steel so as to reduce hot ductility. Thus, an upper limit for the content of S is 0.020% or less. By contrast, a lower limit for the content of S is preferably 0.008% or more because S has an effect of reducing pitting corrosion.

[Al: More than 0.030% and 0.100% or Less]

Al forms N and AlN so as to reduce solid solution N in steel, reduce yield elongation, and reduce stretcher strains. Thus, a lower limit for the content of Al needs to be more than 0.030%. From a viewpoint for reducing yield elongation and improving can manufacturing properties, a lower limit for the content of Al is preferably 0.040% or more. By contrast, if the content of Al is excessive, a large amount of alumina is generated and the alumina remains in a steel sheet, thereby reducing can manufacturing properties. Thus, an upper limit for the content of Al needs to be 0.100% or less.

[N: 0.0005% or More and Less than 0.0030%]

If N exists as solid solution N, yield elongation increases and stretcher strains are generated at the time of drawing processing, and surface appearance is defective. In addition, because a sheet thickness is uneven, this uneven sheet thickness is a factor of trouble in can manufacturing in a next step, and can manufacturing properties are reduced. Thus, an upper limit for the content of N is less than 0.0030%, preferably 0.0025% or less. By contrast, it is difficult to stably define the content of N as less than 0.0005%. If the content of N is less than 0.0005%, manufacturing costs are also increased. Thus, a lower limit for the content of N is 0.0005% or more.

[B: 0.0005% to 0.0030 [N as BN]/[N]>0.5]

B forms BN with N so as to reduce solid solution N and reduce yield elongation. Thus, B is preferably included, and a lower limit for the content of B needs to be 0.0005% or more in order to obtain an effect of additive B. By contrast, if B is excessively included, not only the effect described above is saturated, but also anisotropy of the material is deteriorated and an absolute value of Δr is larger so as to generate an earing. Thus, an upper limit for the content of B is 0.0030% or less. In addition, making the ratio [N as BN]/[N] between the amount of N existing as BN [N as BN] and the whole content of N [N] more than 0.5 enables yield elongation to be 3% or less and tensile strength to be 420 MPa or more. Preferably, [N as BN]/[N]≥0.6.

The balance other than the essential components described above is Fe and inevitable impurities.

[Tensile Strength: 420 MPa to 540 MPa]

Defining a lower limit for tensile strength as 420 MPa or more enables pressure-resistance strength of a can body to be ensured. By contrast, when tensile strength is more than 540 MPa, compatibility between elongation and Δr is extremely difficult. Thus, an upper limit for tensile strength is 540 MPa or less.

[Elongation: 5% or More]

Defining elongation as 5% or more can prevent defective forming such as cracks in neck flange processing and can body part processing such as bead and emboss. Elongation is preferably 8% or more, more preferably, 10% or more. An upper limit for elongation is not particularly specified, but the upper limit for elongation is preferably 25% or less for compatibility with tensile strength.

[Yield Elongation: 3% or Less]

If a lower limit for yield elongation is 3% or less, generation of stretcher strains in drawing processing can be reduced. More preferably, a lower limit for yield elongation is 2% or less.

[Δr: −0.50 to 0.10]

In order to reduce generation of an earing in drawing processing, it is necessary that an absolute value of Δr be small. If Δr is −0.50 to 0.10, generation of an earing is considered as practically a non-problematic level. Preferably, Δr is −0.30 to 0.10. In addition, from a viewpoint for improving drawing processing properties, an average Lankford value (average r value) is preferably 1.1 or more. Similarly to Δr, an average r value can be measured by a natural frequency method disclosed in ASTM A623M.

In addition to the description described above, the following is preferably defined.

[Film Laminated Layer Having a Thickness of 5 m to 40 μm on Both Sides or a Single Side of a Steel Sheet]

Because a coating step can be omitted and corrosion resistance can be ensured, it is preferable that a film laminated layer having a thickness of 5 μm to 40 μm be preferably attached on both sides or a single side of a steel sheet according to embodiments of the present invention so as to make the steel sheet into a laminated steel sheet. When a thickness of a film laminated layer is less than 5 μm, sufficient corrosion resistance is not obtained after can manufacturing. Thus, a lower limit for the thickness is 5 μm or more. By contrast, even when a thickness of a film laminated layer is more than 40 μm, not only an effect is saturated, but also manufacturing costs are increased. Thus, an upper limit for the thickness is 40 μm or less.

In the present invention, a sheet thickness of a steel sheet for a two-piece can is not limited, but a steel sheet for a two-piece can having a sheet thickness of 0.20 mm or less is effective.

<Manufacturing Method for a Steel Sheet for a Two-Piece Can>

[Heating Temperature: 1,100° C. or Higher]

A heating step is a step for heating a slab at a heating temperature of 1,100° C. or higher. If a heating temperature before hot rolling is too low, a part of the nitride is undissolved. This undissolution is a factor of generation of coarse AlN reducing can manufacturing. Thus, a heating temperature in a heating step is 1,100° C. or higher, preferably 1,130° C. or higher. An upper limit for a heating temperature is not particularly specified, but scale is excessively generated and a product surface becomes defective if the heating temperature is too high. Thus, an upper limit for a heating temperature is preferably 1,250° C. or lower.

[Hot-Rolling Finish Temperature: 820° C. to 920° C.]

If a hot-rolling finish temperature is less than 820° C., anisotropy of the material is larger and an absolute value of Δr is larger, thereby reducing can manufacturing properties. Thus, a lower limit for a hot-rolling finish temperature is 820° C. or higher, preferably 8500° C. or higher. By contrast, if a hot-rolling finish temperature is higher than 920° C., a ferrite grain size on a hot-rolled sheet is coarse, a ferrite grain size on an annealed sheet is coarse, and a yield point decreases. Thus, an upper limit for a hot-rolling finish temperature is 920° C. or lower.

[Coiling Temperature: 600° C. to 700° C.]

When a coiling temperature is higher than 700° C., a ferrite grain size of a hot-rolled sheet is coarse, a ferrite grain size of an annealed sheet is coarse, and a yield point decreases. Thus, an upper limit for a coiling temperature is 700° C. or lower. By contrast, when a coiling temperature is lower than 600° C., generation of carbide on a hot-rolled sheet is insufficient and the amount of solid solution C in the hot-rolled sheet increases, and an absolute value of Δr of the annealed sheet is larger and an earing is generated at the time of drawing processing. Thus, a lower limit for a coiling temperature is 600° C. or higher, more preferably 640° C. or higher, and further preferably higher than 670° C.

[Pickling]

A pickling step is a step for pickling a hot-rolled sheet after a coiling step. As a pickling condition, removing a surface scale would be enough, and the condition is not particularly specified. Pickling can be done by a conventional method.

[Cold Rolling: Rolling Reduction Ratio of 85% or More]

A rolling reduction ratio of cold rolling is an important manufacturing condition for making an absolute value of Δr small in order to prevent generation of an earing at the time of drawing processing. If a rolling reduction ratio of cold rolling is less than 85%, Δr increases in the positive direction. Thus, a lower limit for a rolling reduction ratio of cold rolling is 85% or more. By contrast, if a rolling reduction ratio in cold rolling is too large, Δr increases in the negative direction and an earing may be generated. Thus, an upper limit for a rolling reduction ratio of cold rolling is preferably 90% or less.

[Annealing Temperature: 650° C. to 750° C., Over-Aging Temperature Zone: 380° C. to 500° C., Retention Time in Over-Aging Temperature Zone: 30 s or More]

In order to sufficiently recrystallize ferrite grains during annealing and form a texture having small anisotropy, and in order to dissolve the carbide once and reprecipitate the carbide in over-aging treatment, which will be described later, a low limit for an annealing temperature is 650° C. or higher, preferably 680° C. or higher, more preferably higher than 690° C. When especially high elongation is required, a lower limit for an annealing temperature is further preferably higher than 720° C. By contrast, when an annealing temperature is too high, a ferrite grain size is coarse, and a yield point decreases. Thus, an upper limit for an annealing temperature needs to be 750° C. or lower. In addition, from a viewpoint for uniformly heating a steel sheet in a coil, an annealing time is preferably 15 s or more.

Subsequently, it is preferable that an annealed sheet be cooled from an annealing temperature to an over-aging temperature zone that is 380° C. to 500° C., and over-aging treatment for retention time of 30 s or more in the over-aging temperature zone be performed. When an upper limit for an over-aging temperature is higher than 500° C., formation of carbide does not progress, solid solution C remains, and yield elongation is larger, thereby causing stretcher strains. In addition, a yield point excessively increases. Thus, an upper limit for an over-aging temperature zone is 500° C. or lower. By contrast, even when an over-aging temperature is too low, formation of carbide does not progress, solid solution C remains, and yield elongation is larger, thereby causing stretcher strains. Thus, a lower limit for an over-aging temperature zone need to be 380° C. or higher. In this over-aging temperature zone that is 380° C. to 500° C., carbide is retained for a constant time and the carbide is reprecipitated by over-aging, and the amount of solid solution C is reduced so as to reduce yield elongation. When a retention time is short in an over-aging temperature zone, formation of carbide does not progress and an effect of over-aging is small. Thus, a retention time is 30 s or more. From a viewpoint for reducing yield elongation, it is preferable that formation of carbide be advanced by defining a cooling speed from an annealing temperature to an over-aging temperature zone as 40° C./s or higher.

[Secondary Rolling: Rolling Reduction Ratio 5% to 20%]

Because tensile strength is 420 MPa or more in secondary rolling, a lower limit for a rolling reduction ratio is 5% or more. By contrast, if a rolling reduction ratio is too large, elongation is extremely reduced. Thus, an upper limit for a rolling reduction ratio is 20% or less. From a viewpoint for stably ensuring high elongation, an upper limit for a rolling reduction ratio is preferably less than 15%. From a viewpoint for making an absolute value of Δr small, the whole cold-rolling reduction ratio that combines cold rolling with secondary rolling ((hot-rolling thickness−sheet thickness after secondary rolling)/hot-rolling thickness×100) is preferably 90.0% or less.

As described above, a steel sheet for a two-piece can according to the present invention is obtained. As surface processing of a steel sheet, Sn plating, Ni plating, Cr plating, and the like may be applied to the steel sheet. In addition, chemical conversion coating and organic films such as laminate may be applicable. Specifically, when a laminated steel sheet is used, electrolytic Cr acid processing is preferably applied to a surface of the steel sheet.

DETAILED DESCRIPTION OF EMBODIMENTS OF THE INVENTION

Steel including components of steel symbols A to P illustrated in TABLE 1 below and having the balance Fe and inevitable impurities was smelted so as to obtain a steel slab. Using conditions illustrated in TABLE 2 below, the obtained steel slab was heated, was hot-rolled, was wound, and was pickled so as to remove a scale. After that, the steel slab was cold-rolled, was annealed in a continuous annealing furnace and was subjected to over-aging treatment, and was secondary-rolled so as to obtain steel sheets (steel sheets Nos. 1 to 31) having a sheet thickness of 0.16 mm to 0.19 mm. After electrolytic Cr acid processing as surface processing was applied to the steel sheets described above, PET film having a thickness of 20 μm was thermally fused and adhered to both sides of the steel sheets so as to manufacture laminated steel sheets. The manufactured laminated steel sheets were evaluated with the following items 1 to 4.

1. [N as BN]

After the PET films were removed from the laminated steel sheets using concentrated sulfuric acid, the steel sheets were dissolved in bromine-methanol solution, a residue was decomposed in a sulfuric acid and phosphoric acid mixed solution, the amount of B in the solution was measured. Considering that the obtained amount of B formed the whole amount of BN, the obtained amount of B was converted into the amount of N.

2. Yield Stress, Tensile Strength, Elongation, and Yield Elongation

After PET films were removed from the laminated steel sheets described above using concentrated sulfuric acid, a tensile test by JIS No. 5 was obtained from a rolling direction, and yield stress, tensile strength, elongation (whole elongation), and yield elongation were evaluated along with JIS Z2241. Yield stress was evaluated using an upper yield point or 0.2% proof stress when an upper yield point was not seen.

3. Δr

After PET films were removed from the laminated steel sheets described above using concentrated sulfuric acid, tensile test pieces by JIS No. 5 were cut out about a rolling direction, a direction at 45 degrees from the rolling direction, and a direction perpendicular to the rolling direction, and Δr was measured by a natural frequency method disclosed in ASTM A623M.

4. Can Manufacturing Evaluation

In order to evaluate can manufacturing properties, the laminated steel sheets were punched out into a round shape, and a cylindrical cup was formed by drawing processing of a drawing ratio 1.88. A height of the cup edge part was measured at intervals of 15 degrees, and an earing rate was calculated by (maximum edge height−minimum edge height)/average edge height×100. When the earing rate was 3% or less, evaluation was defined as "○", when the earing rate was 2% or less, evaluation was defined as "◎", and when the earing rate was more than 3%, evaluation was defined as "x". In addition, when a cup was visually observed, the cup in which stretcher strains were hardly seen was defined as "◎", the cup in which minor stretcher strains were seen was defined as "○", and the cup in which noticeable stretcher strains were seen was defined as "x".

TABLE 3 below lists evaluation results. All of the examples had the tensile strength of 420 MPa to 540 MPa, the elongation of 5% or more, the yield elongation of 3% or less, and the Δr of −0.5 to 0.1, and had excellent strength and formability. By contrast, in the comparison examples, one or more of the characteristics described above was/were inferior. From the aforementioned, it is confirmed that the present invention can provide a steel sheet for a two-piece can having high strength and excellent formability in drawing processing and ironing processing, and a manufacturing method therefor.

TABLE 1

| Steel symbol | C | Si | Mn | P | S | Al | N | B | Remark |
|---|---|---|---|---|---|---|---|---|---|
| A | 0.021 | 0.01 | 0.17 | 0.014 | 0.009 | 0.051 | 0.0023 | 0.0021 | Example |
| B | 0.010 | 0.02 | 0.19 | 0.015 | 0.008 | 0.044 | 0.0024 | 0.0018 | Example |
| C | 0.028 | 0.03 | 0.15 | 0.013 | 0.012 | 0.053 | 0.0018 | 0.0014 | Example |
| D | 0.018 | 0.01 | 0.39 | 0.015 | 0.013 | 0.045 | 0.0018 | 0.0012 | Example |
| E | 0.015 | 0.02 | 0.10 | 0.015 | 0.015 | 0.045 | 0.0020 | 0.0020 | Example |
| F | 0.019 | 0.03 | 0.30 | 0.016 | 0.011 | 0.035 | 0.0021 | 0.0010 | Example |
| G | 0.025 | 0.02 | 0.21 | 0.012 | 0.011 | 0.043 | 0.0026 | 0.0030 | Example |
| H | 0.022 | 0.03 | 0.18 | 0.010 | 0.009 | 0.032 | 0.0012 | 0.0021 | Example |
| I | 0.020 | 0.01 | 0.15 | 0.016 | 0.009 | 0.035 | 0.0023 | 0.0018 | Example |
| J | 0.018 | 0.02 | 0.16 | 0.016 | 0.012 | 0.063 | 0.0029 | 0.0026 | Example |
| K | 0.018 | 0.01 | 0.22 | 0.014 | 0.013 | 0.012 | 0.0030 | 0.0016 | Comparison example |
| L | 0.026 | 0.02 | 0.22 | 0.014 | 0.008 | 0.054 | 0.0056 | 0.0024 | Comparison example |
| M | 0.003 | 0.01 | 0.26 | 0.012 | 0.010 | 0.043 | 0.0028 | 0.0018 | Comparison example |
| N | 0.052 | 0.02 | 0.22 | 0.013 | 0.010 | 0.050 | 0.0026 | 0.0016 | Comparison example |
| O | 0.016 | 0.03 | 0.55 | 0.016 | 0.005 | 0.042 | 0.0017 | 0.0020 | Comparison example |
| P | 0.024 | 0.02 | 0.32 | 0.018 | 0.009 | 0.018 | 0.0024 | 0.0019 | Comparison example |

TABLE 2

| Steel sheet No. | Steel symbol | Slab heating temperature ° C. | Hot-rolling finish temperature ° C. | Coiling temperature ° C. | Hot-rolling thickness mm | Cold-rolling ratio % | Annealing temperature ° C. |
|---|---|---|---|---|---|---|---|
| 1 | A | 1160 | 870 | 650 | 1.8 | 89.0 | 700 |
| 2 | A | 1160 | 790 | 630 | 1.8 | 89.0 | 700 |
| 3 | A | 1150 | 860 | 570 | 1.8 | 89.6 | 680 |
| 4 | A | 1150 | 850 | 720 | 1.6 | 88.3 | 680 |
| 5 | A | 1150 | 880 | 650 | 2.0 | 90.7 | 680 |

TABLE 2-continued

| | | | | | | | |
|---|---|---|---|---|---|---|---|
| 6 | A | 1170 | 870 | 650 | 1.8 | 88.9 | 820 |
| 7 | A | 1170 | 870 | 620 | 1.8 | 90.1 | 800 |
| 8 | A | 1170 | 860 | 620 | 1.8 | 88.3 | 720 |
| 9 | B | 1180 | 850 | 660 | 1.7 | 88.7 | 690 |
| 10 | C | 1170 | 840 | 640 | 1.6 | 87.3 | 750 |
| 11 | D | 1180 | 870 | 650 | 1.6 | 88.9 | 700 |
| 12 | E | 1180 | 870 | 620 | 1.6 | 88.9 | 720 |
| 13 | F | 1150 | 880 | 650 | 1.8 | 88.6 | 720 |
| 14 | G | 1160 | 850 | 650 | 1.8 | 88.6 | 860 |
| 15 | H | 1130 | 850 | 700 | 1.8 | 88.2 | 710 |
| 16 | I | 1160 | 870 | 650 | 1.8 | 88.6 | 700 |
| 17 | J | 1160 | 870 | 600 | 1.8 | 88.6 | 650 |
| 18 | K | 1160 | 870 | 650 | 1.8 | 88.6 | 700 |
| 19 | L | 1160 | 870 | 650 | 1.8 | 88.6 | 700 |
| 20 | M | 1160 | 870 | 650 | 1.8 | 88.6 | 700 |
| 21 | N | 1160 | 870 | 650 | 1.8 | 88.2 | 700 |
| 22 | O | 1160 | 870 | 650 | 2.0 | 90.2 | 700 |
| 23 | P | 1160 | 870 | 650 | 1.8 | 89.1 | 700 |
| 24 | A | 1160 | 870 | 650 | 1.8 | 89.6 | 700 |
| 25 | A | 1160 | 870 | 650 | 1.8 | 87.0 | 700 |
| 26 | A | 1160 | 870 | 675 | 1.8 | 89.0 | 700 |
| 27 | A | 1160 | 870 | 630 | 1.8 | 88.0 | 730 |
| 28 | G | 1170 | 850 | 650 | 1.8 | 88.6 | 725 |
| 29 | A | 1160 | 870 | 680 | 1.8 | 89.0 | 740 |
| 30 | B | 1180 | 890 | 680 | 1.8 | 89.1 | 730 |
| 31 | F | 1100 | 880 | 680 | 1.8 | 88.6 | 735 |

| Steel sheet No. | Annealing time s | Over-aging time s | Secondary-rolling ratio % | Sheet thickness after secondary rolling mm | Total cold-rolling ratio % | Remark |
|---|---|---|---|---|---|---|
| 1 | 20 | 50 | 9 | 0.18 | 90.0 | Example |
| 2 | 20 | 50 | 9 | 0.18 | 90.0 | Comparison example |
| 3 | 30 | 80 | 9 | 0.17 | 90.6 | Comparison example |
| 4 | 30 | 80 | 9 | 0.17 | 89.4 | Comparison example |
| 5 | 30 | 50 | 9 | 0.17 | 91.5 | Comparison example |
| 6 | 20 | 50 | 10 | 0.18 | 90.0 | Comparison example |
| 7 | 20 | 40 | 10 | 0.16 | 91.1 | Comparison example |
| 8 | 10 | 15 | 10 | 0.19 | 89.4 | Comparison example |
| 9 | 25 | 60 | 8 | 0.18 | 89.4 | Example |
| 10 | 25 | 60 | 10 | 0.18 | 88.8 | Example |
| 11 | 15 | 30 | 10 | 0.16 | 90.0 | Example |
| 12 | 15 | 30 | 10 | 0.16 | 90.0 | Example |
| 13 | 40 | 120 | 12 | 0.18 | 90.0 | Example |
| 14 | 40 | 120 | 12 | 0.18 | 90.0 | Example |
| 15 | 20 | 60 | 15 | 0.18 | 90.0 | Example |
| 16 | 20 | 50 | 12 | 0.18 | 90.0 | Example |
| 17 | 15 | 30 | 12 | 0.18 | 90.0 | Example |
| 18 | 20 | 50 | 12 | 0.18 | 90.0 | Comparison example |
| 19 | 20 | 50 | 12 | 0.18 | 90.0 | Comparison example |
| 20 | 20 | 50 | 12 | 0.18 | 90.0 | Comparison example |
| 21 | 20 | 50 | 15 | 0.18 | 90.0 | Comparison example |
| 22 | 20 | 50 | 8 | 0.18 | 91.0 | Comparison example |
| 23 | 20 | 50 | 8 | 0.18 | 90.0 | Comparison example |
| 24 | 20 | 50 | 4 | 0.18 | 90.0 | Comparison example |
| 25 | 20 | 50 | 23 | 0.18 | 90.0 | Comparison example |
| 26 | 20 | 50 | 9 | 0.18 | 90.0 | Example |
| 27 | 20 | 50 | 9 | 0.18 | 90.0 | Example |
| 28 | 40 | 120 | 12 | 0.18 | 90.0 | Example |
| 29 | 20 | 50 | 9 | 0.18 | 90.0 | Example |
| 30 | 25 | 60 | 8 | 0.18 | 90.0 | Example |
| 31 | 40 | 120 | 12 | 0.18 | 90.0 | Example |

TABLE 3

| Steel sheet No. | [N as BN]/[N] | Yield stress MPa | Tensile strength MPa | Yield elongation % | Elongation % | Δr | Earing rate (%) | Stretcher strain | Remark |
|---|---|---|---|---|---|---|---|---|---|
| 1 | 0.91 | 413 | 430 | 0.6 | 22 | −0.23 | ○ | ◎ | Example |
| 2 | 0.88 | 409 | 440 | 1.2 | 20 | −0.57 | X | ◎ | Comparison example |
| 3 | 0.81 | 466 | 490 | 5.1 | 18 | −0.49 | X | X | Comparison example |
| 4 | 0.90 | 380 | 400 | 0.6 | 22 | −0.21 | ○ | ◎ | Comparison example |

TABLE 3-continued

| Steel sheet No. | [N as BN]/[N] | Yield stress MPa | Tensile strength MPa | Yield elongation % | Elongation % | Δr | Earing rate (%) | Stretcher strain | Remark |
|---|---|---|---|---|---|---|---|---|---|
| 5 | 0.89 | 389 | 405 | 1.4 | 20 | −0.35 | X | ◎ | Comparison example |
| 6 | 0.90 | 538 | 560 | 0.9 | 15 | −0.56 | X | ◎ | Comparison example |
| 7 | 0.87 | 371 | 395 | 1.1 | 20 | −0.26 | ○ | ◎ | Comparison example |
| 8 | 0.90 | 447 | 470 | 3.7 | 18 | −0.24 | ○ | ○ | Comparison example |
| 9 | 0.88 | 403 | 420 | 0.2 | 22 | −0.11 | ◎ | ◎ | Example |
| 10 | 0.89 | 428 | 460 | 1.4 | 21 | −0.29 | ○ | ◎ | Example |
| 11 | 0.78 | 409 | 430 | 0.1 | 21 | −0.26 | ○ | ◎ | Example |
| 12 | 0.95 | 405 | 435 | 0.3 | 20 | −0.19 | ◎ | ◎ | Example |
| 13 | 0.52 | 414 | 440 | 1.6 | 22 | −0.28 | ○ | ○ | Example |
| 14 | 0.88 | 475 | 490 | 0.8 | 18 | −0.22 | ○ | ◎ | Example |
| 15 | 0.92 | 461 | 480 | 0.6 | 18 | −0.17 | ◎ | ◎ | Example |
| 16 | 0.87 | 442 | 475 | 2.0 | 17 | −0.22 | ○ | ○ | Example |
| 17 | 0.83 | 513 | 540 | 1.6 | 18 | −0.32 | ○ | ○ | Example |
| 18 | 0.60 | 446 | 480 | 2.9 | 20 | −0.26 | ○ | X | Comparison example |
| 19 | 0.36 | 576 | 600 | 5.6 | 13 | −0.56 | X | X | Comparison example |
| 20 | 0.75 | 330 | 360 | 0 | 23 | 0.27 | X | ◎ | Comparison example |
| 21 | 0.69 | 572 | 615 | 4.9 | 14 | −0.55 | X | X | Comparison example |
| 22 | 0.94 | 437 | 460 | 1.4 | 20 | −0.51 | X | ◎ | Comparison example |
| 23 | 0.83 | 442 | 470 | 3.2 | 17 | −0.31 | ○ | X | Comparison example |
| 24 | 0.91 | 437 | 450 | 2.1 | 28 | −0.21 | ○ | ○ | Comparison example |
| 25 | 0.91 | 563 | 580 | 0.4 | 2 | −0.27 | ○ | ◎ | Comparison example |
| 26 | 0.96 | 407 | 428 | 0.4 | 24 | −0.14 | ◎ | ◎ | Example |
| 27 | 0.91 | 408 | 425 | 0.5 | 24 | −0.19 | ◎ | ◎ | Example |
| 28 | 0.92 | 451 | 475 | 0.6 | 21 | −0.20 | ◎ | ◎ | Example |
| 29 | 0.96 | 395 | 420 | 0.3 | 25 | −0.11 | ◎ | ◎ | Example |
| 30 | 0.92 | 398 | 422 | 0 | 26 | 0.05 | ◎ | ◎ | Example |
| 31 | 0.57 | 404 | 430 | 0.8 | 25 | −0.13 | ◎ | ◎ | Example |

The present invention can provide a steel sheet for a two-piece can having high strength and excellent formability in drawing processing and ironing processing and a manufacturing method therefor.

The invention claimed is:

1. A steel sheet for a two-piece can, the steel sheet comprising: by mass %, C: 0.010% or more and less than 0.050%; Si: 0.04% or less; Mn: 0.10% or more and less than 0.40%; P: 0.02% or less; S:0.020% or less; Al: more than 0.03% and 0.100% or less; N: 0.0005% or more and less than 0.0030%; B: 0.0005% to 0.0030%; and balance Fe and inevitable impurities, wherein an amount of N that is present as BN and a whole amount of N satisfy the following expression (1):

$$1.0 \geq [N \text{ as } BN]/[N] > 0.5 \quad (1),$$

where N as BN represents the amount of N that is present as BN, and N represents the whole amount of N, a tensile strength is 420 MPa to 540 MPa, an elongation is 5% or more, a yield elongation is 3% or less, and a Δr is −0.50 to 0.10.

2. The steel sheet for a two-piece can according to claim 1, further comprising: a film laminated layer having a thickness of 5 μm to 40 μm on both sides of the steel sheet or on a single side of the steel sheet.

3. The steel sheet for a two-piece can according to claim 1, wherein the steel sheet comprises, by mass %, C: 0.010% or more and less than 0.020%.

4. A method of manufacturing the steel sheet according to claim 1, the method comprising:

heating a slab at a heating temperature of 1,100° C. or higher;

hot-rolling, under the condition of a hot-rolling finish temperature of 820° C. to 920° C., the slab after the heating;

coiling, at a coiling temperature of 600° C. to 70° C., a hot-rolled sheet obtained by the hot-rolling;

pickling the hot-rolled sheet after the coiling;

cold-rolling the hot-rolled sheet under the condition of a rolling reduction ratio of 85% or more after the pickling;

annealing, under the condition of an annealing temperature of 650° C. to 750° C., a cold-rolled sheet obtained by the cold-rolling; and rolling, under the condition of a rolling reduction ratio of 5% to 20%, an annealed sheet obtained by the continuous annealing.

5. A method of manufacturing the steel sheet according to claim 1, the method comprising:

heating a slab at a heating temperature of 1,100° C. or higher;

hot-rolling, under the condition of a hot-rolling finish temperature of 820° C. to 920° C., the slab after the heating;

coiling, at a coiling temperature of 600° C. to 700° C., a hot-rolled sheet obtained by the hot-rolling;

pickling the hot-rolled sheet after the coiling;

cold-rolling the hot-rolled sheet under the condition of a rolling reduction ratio of 85% or more after the pickling;

annealing, under the condition of an annealing temperature of 650° C. to 750° C., a cold-rolled sheet obtained by the cold-rolling and performing an over-aging treatment where a retention time in a temperature range of 380° C. to 500° C. is 30s or more; and rolling, under the condition of a rolling reduction ratio of 5% to 20% an annealed sheet obtained by the continuous annealing step.

6. The method of manufacturing the steel sheet according to claim 4, the method further comprising:

forming a film laminated layer having a thickness of 5 μm to 40 μm on both sides of the steel sheet or on a single side of the steel sheet.

7. The method of manufacturing the steel sheet according to claim 5, the method further comprising:

forming a film laminated layer having a thickness of 5 μm to 40 μm on both sides of the steel sheet or on a single side of the steel sheet.

* * * * *